United States Patent [19]

Batson

[11] 4,245,533

[45] Jan. 20, 1981

[54] MOTORIZED CIRCULAR MITER CHOP SAW

[75] Inventor: William A. Batson, Pickens, S.C.

[73] Assignee: The Singer Company, Stamford, Conn.

[21] Appl. No.: 61,163

[22] Filed: Jul. 26, 1979

[51] Int. Cl.[3] ..... B26D 1/16

[52] U.S. Cl. ..... 83/471.3; 83/473; 83/490; 83/522; 83/589

[58] Field of Search ..... 83/471.2, 471.3, 472, 83/473, 477.2, 490, 491, 508.2, 522, 581, 589, 597, 699; 51/68, 98, 98.5, 99, 126, 147; 125/13 SS

[56] References Cited

U.S. PATENT DOCUMENTS

| | | | |
|---|---|---|---|
| 2,630,146 | 3/1953 | Van Tuyl | 83/574 |
| 2,851,068 | 9/1958 | Goodlet | 83/581 X |
| 3,139,124 | 6/1964 | Hoot | 83/522 X |
| 3,821,918 | 7/1974 | Niehaus et al. | 83/471.3 |
| 3,998,121 | 12/1976 | Bennett | 83/471.3 |
| 4,002,094 | 1/1977 | Erickson et al. | 83/471.3 |
| 4,011,782 | 3/1977 | Clark et al. | 83/471.3 |

*Primary Examiner*—Frank T. Yost
*Assistant Examiner*—Robert P. Olszewski
*Attorney, Agent, or Firm*—Elliot A. Lackenbach; Robert E. Smith; Edward L. Bell

[57] ABSTRACT

A motor operated circular miter chop saw is pivotally mounted on a generally horizontal axle pivot bolt about which it rotates in a vertical plane with the axle pivot bolt being carried by a cast support base structure provided with means allowing lateral adjustment of one end of the axle pivot bolt and vertical adjustment of the other end. Angular orientation of the work piece is provided by an angularly adjustable fence rotatably carried by the cast base support structure with the fence having lugs cooperating with an arcuate slot or groove provided in the cast base support structure. The cast base support structure is also provided with an arcuate slot to provide clearance for the circular saw blade while an adjustable stop is provided carried by the cast support base to preclude the circular saw blade from contacting the cast support base structure. Spring means are also provided for biasing the saw to an upwardly pivoted position.

8 Claims, 4 Drawing Figures

Fig. 1.
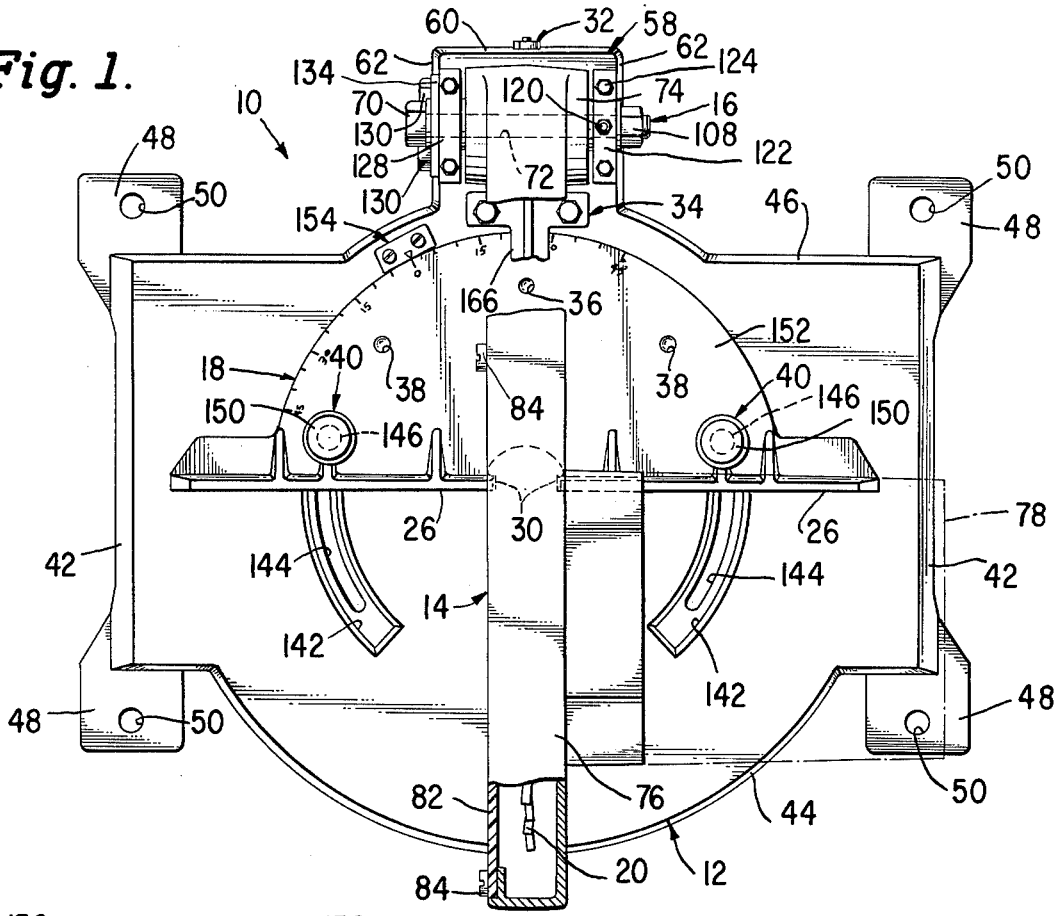
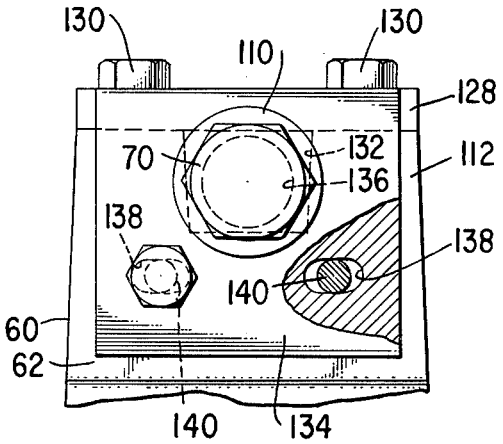
Fig. 3.
Fig. 2.
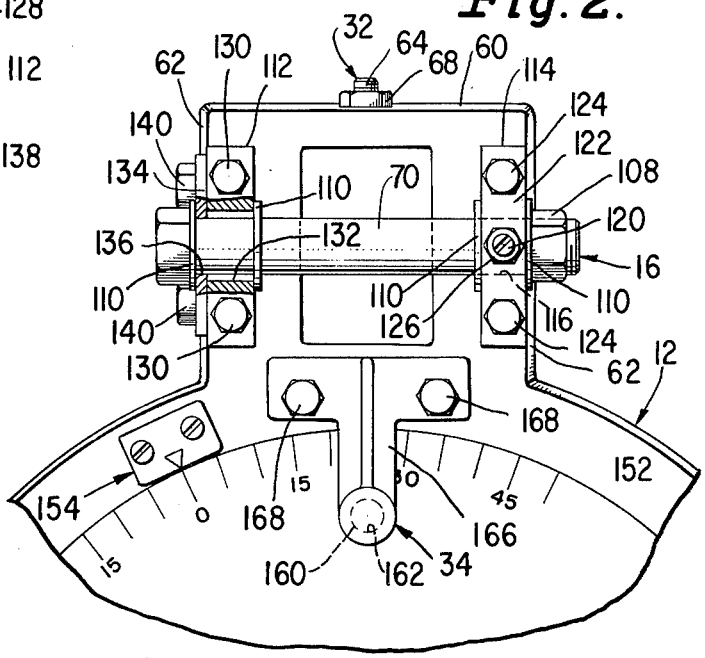

MOTORIZED CIRCULAR MITER CHOP SAW

DESCRIPTION

Field of the Invention

This invention relates to powered circular saws and, more particularly, to a powered circular saw hingedly mounted to a table having a rotatably positionable fence for cutting elongated stock material such as wood to length at various reproducable angles.

BACKGROUND OF THE INVENTION

In various crafts projects it is useful to be able to accurately cut elongated stock material, such as strips of wood, or the like, to length and at accurately reproducable angles. For example, in many construction projects it is desired to cut strips of wood so that the end cut is square, that is perpendicular to the longitudinal axis of the wood strip. At other times it is desirable to cut at angles other than 90° such as at a 45° angle to enable two such strips to be mitered to provide a square or right angle corner joint. Motorized miter saws, in which a power driven circular saw is pivotally supported on a support member for vertical swinging movement downwardly from a normal inoperative rest position towards a work support base structure while also pivotally supporting the saw support member on a vertical axis for angular swinging movement to preselected angular positions to effect a desired angle cutting of the work piece have been previously shown and saws of this type are disclosed, for example, in Niehaus et al. U.S. Pat. No. 3,821,918 and are commonly referred to as chop saws. A disadvantage of such saws is the necessity for pivoting the saw assembly for angular setting and the weight and vibration of the saw necessitates that the saw support member be rather heavy and closely machined to provide for long life and continued accuracy. Among other disadvantages, this necessity makes such construction more expensive than might be otherwise desirable. Moreover, since the saw blade must descend to a position beneath the work supporting surface in order to completely sever the work piece, means must be provided to enable the saw to pass through the work supporting surface at a number of angular positions which further increases the complexity and, accordingly, the cost of such saws. In some saws this is achieved by providing a rotating platform which rotates with the saw, further adding to the complexity and expense of the machine. If such means are not provided, then a disposable work supporting surface, such as a piece of scrap wood, must be used beneath the work piece or a movable fence, or the like must be provided to enable relative lateral movement of the work piece and the saw path, therefore necessitating both the chopping movement of the saw and lateral movement of the work piece or saw which results in a loss of convenience and a possible lessening of accuracy as well as an increase in complexity and expense.

Without getting into truly massive or welded structures for the work support base structure, the most economical basic fabrication method to provide the requisite rigidity and strength is to cast the structure of metal. While such cast structures are basically inexpensive in comparision with a welded structure, a cast structure has the basic inconvenience that working surfaces need to be subsequently machined because the surface finish produced by processes such as sand casting are generally insufficient for work supporting surfaces and are definitely insufficient for bearing surfaces about which the chop saw pivots. Moreover, because of the limitation of the sand casting process and the contraction of metal during cooling following casting, actual dimensions are subject to substantially large tolerances which necessitate that critical surfaces and the structure defining pivotal axis be subsequently machined and each machining operation necessitated by the design generally increases the cost of the machine.

OBJECTS OF THE INVENTION

Accordingly, it is a primary object of the present invention to provide novel and improved miter saws designed, constructed and arranged to maximize economy of production while simultaneously maintaining acceptable accuracy.

Another primary object of the present invention, in addition to the foregoing object, is the provision of novel and improved miter saws utilizing a cast base structure to which a motor powered circular chop saw is pivotally mounted for rotation about a horizontal axis wherein a minimum of machining is required to the base structure casting.

Yet another primary object of the present invention, in addition to each of the foregoing objects, is the provision of such a miter saw wherein novel and improved mounting means are utilized for mounting the motor powered circular chop saw to the base support structure wherein the axis of rotation is adjustable in a first direction rotationally in a plane generally parallel said work support surface and in a second direction rotationally in a plane generally perpendicular said work support surface so as to enable accurate orientation of the motor powered chop saw relative the base support structure without requiring excessive accuracy in the initial fabrication of the cast base support structure.

Still another primary object of the present invention, in addition to each of the foregoing objects, is the provision of novel and improved motor powered circular miter chop saws wherein rotation of the motor powered chop saw relative to the base is not required for adjustment of angular orientation to the work piece to be cut whereby the mounting means between the motor powered chop saw and the cast mounting base structure need only provide for rotation of the motor driven circular chop saw about a horizontal axis for movement of the motor driven chop saw in a vertical plane, and thereby enabling novel and improved adjustment means to be utilized for adjusting the orientation of the rotational axis of the motor driven chop saw relative the cast base support structure.

Yet still another primary object of the present invention, in addition to each of the foregoing objects, is the provision of such motor driven miter chop saws wherein the rotational axis for the motor driven chop saw relative the cast base support structure comprises means at one end of an axle bolt around which the motor powered circular saw pivots for providing lateral adjustment thereof and means associated with the other end of the axle bolt for providing vertical adjustment thereof whereby accurately machined sockets for the two ends of the axle bolt are not required.

Another and yet still further primary object of the present invention, in addition to each of foregoing objects, is the provision in a motor powered miter chop saw of the class described of an adjustable stop defining the lowermost position of the motor powered circular chop saw relative the cast base support structure for precluding the circular saw thereof from contacting the cast support base.

Yet still another and further primary object of the present invention, in addition to each of the foregoing objects, is the provision in a motor driven circular miter chop saw of the class described of an angularly adjustable fence against which a work piece may be positioned to define the angle of cut thereof and thereby enabling the angular orientation of the chop saw laterally of the cast support base upon which the work piece may also be supported to be fixed so that a single arcuate segmental recess may be provided for clearance of the circular saw blade to sever the work piece at any desired angle by mere lowering pivotal action of the chop saw.

Yet another and still further primary object of the present invention, in addition to each of the foregoing objects, is the provision in a motor driven circular miter chop saw of the class defined, spring actuated detent means on such angularly adjustable fence to define especially desirable angular orientation adjustments thereof such as, for example, square or 90° cutting (alternatively referred to a 0° of miter) and 45° cutting orientations.

A further and still another primary object of the present invention, in addition to each of the foregoing objects, is the provision, in motor driven circular miter chop saws of the class defined of novel and improved biasing means for biasing the horizontally pivoted chop saw to an upward or open position for insertion of an elongated piece under the motor driven circular saw blade for cutting.

Still another and yet still further primary object of the present invention, in addition to each of the foregoing objects, is the provision, in a motor driven circular miter chop saw of the class defined of locking means for the fence to positively maintain the fence aligned in a desired angular orientation.

A yet still further primary object of the present invention, in addition to each of the foregoing objects, is the provision, in a motor driven circular miter chop saw of the class described having a rotatable fence for angularly positioning an elongated work piece, of a arcuate rib or plurality of arcuate rib segments depending from the fence engaged with and cooperating with a generally arcuate groove provided in the cast base support member for guiding such fence around a vertual pivot centered in or adjacent the plane of the circular saw blade.

It is a feature of the present invention that the saw is constructed primarily from relatively inexpensive castings eliminating a number of parts from conventional construction and requiring a minimum of machined parts maximizing economy of manufacture while yet providing an accurate and durable tool.

The invention resides in the combination, construction, arrangement and disposition of various component parts and elements incorporated in improved motor driven circular miter chop saws constructed in accordance with the principles of this invention. The present invention will be better understood and objects and important features other than those specifically enumerated above will become apparant when consideration is given to the following details and description which, when taken in conjunction with the annexed drawing describes, discloses, illustrates and shows a preferred embodiment or modification of the present invention and what is presently considered and believed to be the best mode of practicing the principles thereof. Other embodiments and modifications may be suggested to those having the benefit of the teachings herein, and such other embodiment or modifications are intended to be reserved, especially as they fall within the scope and spirit of the subjoined claims.

SUMMARY OF THE INVENTION

In accordance with the present invention a motor operated circular miter chop saw is pivotally mounted on a generally horizontal axle pin or bolt about which it rotates in a vertical plane with the axle bolt being carried by a cast support base structure provided with means allowing lateral adjustment of one end of the axle bolt and vertical adjustment of the other end thereof enabling inexpensive and easy adjustment for manufacturing tolerances in the cast support base structure. Angular orientation of the work piece is provided by an angularly moveable fence rotatably carried by the cast base support structure with the fence having lugs cooperating with an arcuate slot or groove provided in the cast base support structure. The cast base support structure is also provided with an arcuate slot extending perpendicular the chop saw axle bolt to provide clearance for the circular saw blade, the blade being aligned with the arcuate slot by the axle bolt adjustment means while an adjustable stop is provided carried by the cast support base to preclude the circular saw blade from contacting the base of the arcuate clearance slot in the cast support base structure. Detent means are provided for locating the rotatable fence structure for work piece cut off at a right angle or 90° (sometimes referred to as 0° of miter) as well as at 45° right and left orientation. Lock means are also provided for firmly locking the fence in a desired orientation, whether in the detent position or any position therebetween and biasing means are provided for biasing the chop saw to an upward position enabling insertion of an elongated work piece therebeneath.

While the saw described is primarily intended for the cutting of soft material such as wood, utilizing a wood cutting blade, it is intended that this application also cover similar devices provided with metal cutting blades, abrasive discs, and the like, for cutting and facing diverse materials.

BRIEF DESCRIPTION OF THE DRAWING

Further objects and features of the present invention will appear from the following description and appended claim when read in conjunction with the accompanying drawing wherein:

FIG. 1 is a top plan view, partially broken away of a motorized circular miter chop saw constructed in accordance with the present invention;

FIG. 2 is an enlarged top plan view of the hinge portion of the chop saw shown in FIG. 1 whereby the circular saw is pivotally mounted to the base support structure, partially broken away and with the circular saw blade, blade guard and motor assembly removed for more clearly illustrating the mounting arrangement of the axle bolt with the base support structure;

FIG. 3 is an enlarged partial elevational view, of a portion of the hinge bolt mounting arrangement as viewed from the left side of FIG. 2 to show with FIG. 2 how the lefthand end of the axle bolt is horizontally adjustable.

DETAILED DESCRIPTION OF THE INVENTION

Figure 4:
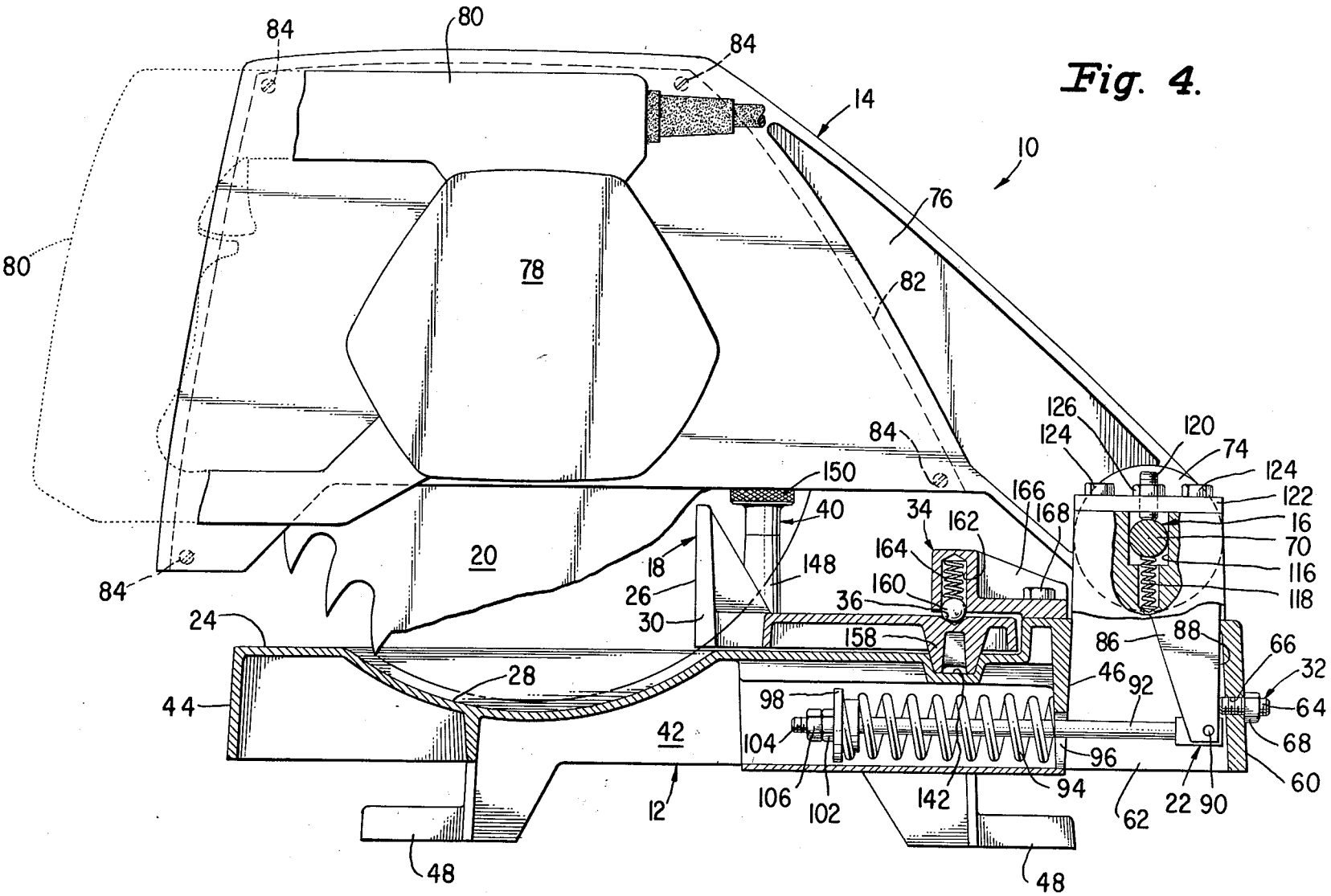
FIG. 4 is an enlarged end elevational view of the motor powered circular miter chop saw of FIG. 1, viewed from the right of FIG. 1, partially broken away generally adjacent the circular saw blade to illustrate the fence mounting arrangement, detent means supporting the fence for 90° (or 0°) cut off of a work piece and the biasing means for raising the chop saw for insertion of a work piece therebeneath, the stop means for limiting the downward travel of the saw blade to prevent contact thereof with the base support structure and further partially broken away at a plane offset the centerline to show the mounting of the hinge bolt at the righthand end of FIGS. 1 and 2 illustrating how that end of the hinge bolt is vertically adjustably mounted with the cast base support structure.

With reference now to the drawing, there is shown and illustrated a motor operated circular miter chop saw constructed in accordance with the principles of the present invention and designated generally by the reference character 10. The miter saw 10 comprises a cast base structure designated generally by the reference character 12, a motor driven circular saw structure designated generally by the reference character 14 rotatably carried on a pivot assembly generally designated by the reference character 16 mounted with the cast base structure 12 and a rotatable fence structure designated generally by the reference character 18 rotatably carried by the cast base structure 12 for limited rotational movement about a vertual pivot located or adjacent the plane of the circular saw blade 20 of the motor driven circular saw 14. In addition, biasing means generally designated by the reference character 22 are provided for biasing the circular saw 14 in an upward direction towards an open position whereat the circular saw 14 is generally spaced above the cast base portion structure 12 for the insertion of an elongated work piece therebetween to rest on a work supporting surface 24 defined by the top surface of the cast base portion 12 and against the work supporting face 26 on the fence structure 18 generally perpendicular the work supporting surface 24. A generally arcuate depression or clearance slot 28 is provided in the cast base structure 12 in general alingment with the circular saw blade 20 to enable the circular saw blade 20 to pass through the plane of the work supporting surface 24 as the saw is lowered against the force of the biasing means 22 to cut the work piece. The fence structure 18 is also provided with a generally central slot 30 to provide clearance for the saw blade for the same purpose, the slot being wide enough to accommodate the saw blade even at the extreme of the fence rotation. Adjustable stop means 32 are also provided for limiting the downward pivoting chop motion of the motorized circular saw 14 to prevent the circular saw blade 20 from contacting the bottom of the saw clearance groove 28 or the fence structure 18 rearward of the saw clearance slot 30. Detent means designated generally by the reference character 34 are provided to quickly and easily locate the fence structure 18 rotatably in any of several preferred positions such as, for example, perpendicular the plane of the saw blade 20 and at 45° angles right and left thereof by cooperation with either a central cup detent 36 or either of to offset cup detents 38 offset 45° from the central detent 36. A pair of locking means designated generally by the reference character 40 are also provided for positively locking the fence structure 18 in a desired angular orientation.

In addition to the upper work supporting surface 24, the cast base structure 12 further comprises a pair of side walls 42, a front wall 44 and a rear wall 46, each depending therefrom with laterally outwardly extending feet 48 being integral with the lower edges of the walls 42, 44 and 46 at the four corners for supporting the miter chop saw 10 on a table, or the like. Mounting apertures 50 are provided in each foot 48 to enable the miter chop saw 10 to be fastened in position. Projecting generally rearwardly of the rear wall 46 of the cast base structure 12 and forming an integral part thereof, there is provided a generally U-shaped channel portion 58 having a rear wall 60 generally parallel of the rear wall 46 and a pair of side wall portions 62 generally parallel the side walls 42 and extending upwardly above the plane of the work supporting surface 24 to define a pair of mounting ears forming a part of the circular saw mounting means 16. The adjustable stop means 32 is carried by the rear wall 60 and comprises a threaded stud 64 threadedly engaged through a threaded aperture 66 provided through the rear wall 60 so that the forward end of the threaded stud may be adjustably extended into the U-shaped channel 58 and a lock or jam nut 68 is provided to lock the threaded stud 64 in the desired position.

As heretofore pointed out, the circular saw structure 14 is pivotally mounted, and the support means 16 therefore comprises a pin or pivot bolt 70 extending through the side walls 62 and adjustably mounted therein so as to be adjustable in a first direction rotationally in a plane generally parallel said work support surface and in a second direction rotationally in a plane generally perpendicular said work support surface as will be hereinafter described and through a bore 72 extending through a boss 74 integrally formed with a blade guard and motor supporting casting 76 forming the main supporting structure of the circular saw structure 14. The blade guard casting 76 has an electric motor 78 mounted to one side thereof for driving the circular saw blade 20 and carrying a handle portion 80 for enabling the circular saw assembly 14 to be controlled, i.e., lowered for cutting action and raised slowly with the biasing means 22. The blade guard casting 76 is generally open on the side thereof opposite the motor 78 and is closed by means of a generally flat sheetlike cover plate 82 held in position as by means of screws 84 passing through the cover plate 82 and threadedly engaged in threaded holes suitably provided in the blade guard casting 76. The cover plate 82 can therefore be removed, as necessary, for removal and replacement of the circular saw blade 20 as required.

Integrally formed with the blade guard casting 76 generally on the opposite side of the mounting boss 74 there is provided generally downwardly extending crank arm 86, the rearward edge 88 of which may engage the inward end of the threaded stud 64 of the adjustable stop means 32 to limit the pivotal movement of the blade guard casting 76 and, therefore, of the circular saw assembly 14. The distal end portion of the crank arm 86 is pivotally connected, as by means of a pin 90 to a control rod 92 pulled by an actuating spring 94 to therewith define the biasing means 22. The control rod 92 extends through an aperture 96 provided in the rear wall 46 and the rearward end portion of the spring 94 bears against the rear wall 46 generally surrounding the control rod 92. The spring 94 is maintained under compression at the forward end portion by a thrust washer 98 annularly mounted on the control rod 92 adjacent the forward end portion of the spring 94 and the thrust washer 98 is held in position by a thrust nut 102 installed on a threaded end portion 104 of the control rod 92 and, in turn, locked in position by means of a jam or lock nut 106.

As will be apparent, the tension applied to the control rod 92 by the compression spring 94 tends to rotate the crank arm 86 in a clockwise direction as seen in FIG. 4 thereby biasing the circular saw assembly 14 to an upward, open position.

The axle pin or pivot bolt 70 is provided with a nut 108 holding it axially in position and passes through the saw guard casting hub 72, both side walls 62, as well as four bearing washers 110, two washers being positioned on each side of a pair of thickened generally rectangular bosses 112 and 114 formed with, respectively, and extending generally upwardly from, each of the two side walls 62. The righthand end of the axle bolt 70 is vertically adjustable in the thickened boss 114 on the righthand side wall 62 while the lefthand end of the axle bolt 70 is horizontally adjustable within the thickened boss 112 on the lefthand one of the walls 62. Hence, the circular saw blade 20 may be aligned with the arcuate saw clearance slot 28 and to be perpendicular the work support surface 24. As shown in more detail in FIG. 4, the thickened portion 114 of the righthand one of the side walls 62 is provided with a generally U-shaped recess 116 elongated in the vertical direction within which the axle or pivot bolt 70 is positioned and the axle bolt 70 is vertically adjusted therewithin by means of a compression spring 118 beneath the axle bolt 70 and an adjusting screw 120 passing downwardly through a hold down strap 122 attached to the thickened portion 114, as by means of a pair of cap screws 124. A lock or jam nut 126 is provided to hold the adjusting screw 120 in position.

At the lefthand end, the axle bolt 70 is retained in position by a hold down strap 128 held in position by a pair of cap screws 130 and an aperture 132 elongated in a horizontal direction is provided which is larger than the axle bolt 70 permitting the axle bolt 70 to be at least laterally adjustable therewithin and a further plate 134 is provided having an aperture 136 which is a close fit around the axle bolt 70. The plate 134, in turn, is provided oversize horizontally elongated apertures 138 enabling it to be affixed adjustably sideways on the lefthand side wall 62, as by means of cap screws 140.

The work supporting surface 24 of the cast base structure 12 is provided with an arcuate groove 142 for guiding the fence structure 18. Through the base of the groove 142 the cast base structure 12 is also provided with an arcuate slot 144 through which a pair of carriage bolts, or the like, 146 are provided as part of the locking means 40 for locating the fence structure 18 in a desired angular orientation. The slot 144 subtends about 275° so that the fence 18 may be rotated at least 45° each side of center. Cooperating with the carriage bolts 146 are a pair of sleeves 148 and crown nut portions 150 which, when tightened on the carriage bolts 146 are effective to lock the fence structure 18 in a desired angular orientation. The fence structure 18 further comprises a generally semicircular base portion 152 provided with angular degree markings and there is also provided on the cast base structure 12 an indicator means 154 adjacent the periphery of the semi-circular portion 152. It will be noted that the indicator means 154 and the angular degree markings are offset from the angle of the fence face 26 so as not to be obscured by the blade guard 14. The fence is also provided with at least one depending boss 158 riding in the groove 142 to guide the fence structure 18. Preferably, three bosses are provided about 90° apart. The detent means 34 comprises a detent ball 160 held in a socket 162 also holding a detent spring 164 provided in a detent bracket 166 mounted to the cast base support structure, as by means of cap screws 168.

I claim:

1. Miter saw comprising a cast base structure having a generally planar work support surface to which a motor powered circular chop saw is pivotally mounted for rotation about an axis generally parallel said work support surface, together with mounting means utilized for mounting the motor powered circular chop saw to the base support structure wherein the axis of rotation is adjustable in a first direction rotationally in a plane generally parallel said work support surface and in a second direction rotationally in a plane generally perpendicular said work support surface so as to enable accurate orientation of the motor powered chop saw relative to the base support structure without requiring excessive accuracy in the initial fabrication of the cast base support structure and a work piece positioning fence rotatably carried by said base support structure.

2. Miter saw defined in claim 1 wherein said mounting means for enabling adjustment of the rotational axis of said motor powered circular chop saw relative said cast base support structure comprises, in turn, an axle pivot bolt carried by said cast base support structure, means at one end of said axle pivot bolt around which the motor powered circular saw pivots for providing lateral adjustment of the axis of said bolt, and means associated with the other end of said axle pivot bolt for providing vertical adjustment thereof whereby a need for accurately machined sockets for the two ends of the axle bolt is reduced.

3. Miter saw defined in claim 2 wherein said lateral adjustment means comprises a support plate having an aperture closely fitting said axle pivot bolt and at least one horizontally elongated attachment aperture, said cast base having an enlarged opening through which said axle bolt passes loosely, said support plate being adjustably mounted with said cast support base structure with said closely fitting aperture over said enlarged opening to position said axle bolt relative said cast support base structure by threaded fastener means passing through said elongated attachment aperture engaging said cast support base structure.

4. Miter saw defined in claim 2 wherein said vertical adjustment means comprises a vertically elongated opening in said cast base support structure through which said axle bolt passes, spring means beneath said axle bolt biasing it upwardly in said slot and adjustable stop means above said axle bolt for limiting its upward movement.

5. Miter saw defined in any of claims 1, 2, 3, or 4 further comprising an adjustable stop carried by the cast base defining the lowermost position of the motor powered circular chop saw relative the cast base support structure for precluding the circular saw thereof from contacting the cast support base.

6. Miter saw defined in any of claims 1, 2, 3, or 4 further comprising a lever arm extending from said motor powered circular chop saw past said axle pivot into said cast support base structure and spring means for connecting the distal end of said lever arm with said cast base support structure for biasing said distal end forwardly within said cast base support structure so that said motor powered circular chop saw is thereby biased pivotally upwardly away from said work support surface.

7. Miter saw defined in any of claims 1, 2, 3 or 4 further comprising spring actuated detent means on said angularly adjustable fence to define especially desirable angular orientation adjustments thereof such as, for example, square or 90° cutting and 45° cutting orientations.

8. Miter saw defined in any of claims 1, 2, 3, or 4 wherein said rotatable fence comprises a plurality of arcuate rib segments depending from the fence engaged with and cooperating with a generally arcuate groove provided in the cast base support member for guiding such fence around a vertual pivot centered in or adjacent the plane of the circular saw blade.

* * * * *